United States Patent [19]

Goncalves

[11] Patent Number: 4,482,082

[45] Date of Patent: Nov. 13, 1984

[54] DISPENSING CAP FOR PRESSURIZED CONTAINER

[75] Inventor: Antonin L. Goncalves, Groslay, France

[73] Assignee: L'Oreal, Paris, France

[21] Appl. No.: 438,635

[22] Filed: Nov. 2, 1982

[30] Foreign Application Priority Data

Dec. 3, 1981 [FR] France ..... 81 22649

[51] Int. Cl.[3] ..... B67B 5/00

[52] U.S. Cl. ..... 222/182; 222/153

[58] Field of Search ..... 222/182, 402.13, 402.11, 222/541, 153; 215/253, 254; 220/270

[56] References Cited

U.S. PATENT DOCUMENTS 3,263,868 8/1966 Sagarin ..... 222/182

*Primary Examiner*—Stanley H. Tollberg

*Attorney, Agent, or Firm*—Cushman, Darby & Cushman

[57] ABSTRACT

A dispensing cap for pressurized containers such as aerosol bombs includes a cap proper and a push button within the cap intended to operate the dispensing valve of the pressurized container with the cap presenting an upper wall including a pilfer-proofing plate to prevent premature operation of the push button therebelow contained in the cap; the plate is fixed to the cap itself with the aid of a frangible connection to be ruptured before use to provide access to the push button, the pilfer-proofing plate presenting at its extremity near the lateral wall of the cap a return disposed as an extension of the lateral wall of the cap; the pilfer-proofing plate presenting a cut-out determining, on the return, a panel capable of hinging by elastic deformation to move aside at least partially to permit access to one edge of the cut-out to be grasped by a user to remove the plate to gain access to the push button.

9 Claims, 4 Drawing Figures

DISPENSING CAP FOR PRESSURIZED CONTAINER

FIELD OF THE INVENTION

The present invention relates to a dispensing cap for pressurised containers such as containers/"aerosol bomb" type.

More particularly, the invention relates to such a dispensing cap of the type containing within the cap proper a push button intended to operate the dispensing valve of the pressurised container, the cap presenting in particular an upper wall including a "pilfer proofing" plate intended to prevent premature operation of the push button therebelow contained in the cap, this plate being fixed to the cap itself with the aid of frangible connections to be ruptured before use and thus to provide access to the push button.

The invention may particularly be adapted for moulded dispensing caps of the type comprising a cap body in which is embedded a sleeve comprising a push button articulated to the sleeve, the sleeve being substantially in abutment with an element of the pressurised container such as, for example, a crimped rim of the valve-carrying cup, the cap body carrying in its upper part said pilfer-proofing plate and comprising, on a lateral wall, a window provided in register with the discharge nozzle of the push button. However, the invention may equally be applied to other types of cap in which the push button is contained within the cap, access to the push button being impossible as long as a frangible pilfer proofing plate initially fixed to the cap has not been ruptured.

PRIOR ART

It is already known to provide caps for pressurised containers of the aerosol bomb type, utilised for example for dispensing costmetic products is powdered form, these caps presenting an upper surface whose one part is constituted by a pilfer proofing plate connected to the rest of the surface by frangible connections, this plate comprising towards its rear edge, that is to say around the end of the push button opposite to the discharge nozzle, a right angled return so that the plate itself prevents access to the upper part of the push button when its rear return blocks a window provided in the lateral wall of the cap, this window being intended to permit the finger of the user subsequently, after removal of the plate, to depress the push button during functioning of the dispensing valve of the container.

In certain types of prior art containers, in order to enable the user to grip the removable plate, the right angle return of this plate is disposed not at the rear edge of the plate but on the plate at a certain distance from this edge, in order that the user will have a relief, constituted by the rear end of the plate, to be able to raise and to rupture the pilfer-proofing plate. However, such an arrangement will reduce the length of the space available for the push button within the container and imposes the requirement to use shorter push buttons then normally permitted by the same diameter of cap. Furthermore, the push button generally comprises a surface on which the finger of the user rests and at the end of travel the finger touches the lower edge of the window provided in the lateral wall of cap for the passage of this finger, which is uncomfortable for the user.

If it is desirable to avoid this disadvantage, it is necessary to provide the return of the pilfer-proofing plate in the extension of the lateral wall of the cap by providing on said return a fingernail receiving recess which enables the pilfer-proof plate to be gripped. In this case, the push button may come just to the lateral wall of the cap and may be operated without the finger touching the lower rim of the corresponding window but then it is necessary to provide in the mould for manufacturing the cap, a lateral slide intended to form the said nail-receiving recess; the presence of this slide increases the cost of the mould and reduces the rate of moulding, which involves an increased cost of the dispensing cap.

SUMMARY OF THE INVENTION

The present invention proposes to overcome these disadvantages and to provide a dispensing cap for a pressurised container presenting a pilfer-proofing upper plate with a return and permitting the provision within the cap proper, of a push button of maximum length without increasing the cost of moulding and without contact of the finger of the user with the rim of the window during movement in use.

Another object of the invention is to provide such a device which permits a simple gripping of the pilfer-proofing plate without requiring a relief capable of provoking premature partial or total removal of the pilfer-proofing plate.

Another object of the invention is to make it possible to provide means for producing the pilfer-proofing plate using moulding tools which do not require any movable slide.

The invention relates to a dispensing cap for a pressurised container, comprising an upper wall surrounded by a lateral wall and enclosing internally a push button whose upper face is situated at a small distance below the said upper wall, a pilfer-proofing plate being disposed above said push button and being joined to the rest of the cap by frangible connections, said pilfer-proofing plate presenting at its extremity near the lateral wall of the cap, that is to say away from the window for passage of pulverised fluid, a return substantially oriented, at this place, with the adjacent part of said lateral wall, means being provided for enabling easy gripping of said pilfer-proofing plate with a view to its removal, characterised by the fact that said return is disposed as an extension of the lateral wall of the cap and in that said pilfer-proofing plate presents, at this end, a cut-out determining on said return, a panel capable of hinging by elastic deformation to move aside at least partially and to permit access to one edge of the cut-out which, once grasped, allows removal of said plate to gain access to the push-button.

The fact of disposing the return of the pilfer-proofing plate as an extension of the lateral wall of the cap enables the volume available for the push button to be at a maximum.

Advantageously, said panel may be able to be hinged, under the pressure of a finger, inwardly of the cap and to permit the corresponding edge of the cut-out of the part of the plate facing the panel to be gripped, thus ensuring grip of the plate to permit it to be removed.

In a particularly advantageous manner, said cut-out may comprise a substantially horizontal part situated at the level of the geometrical zone of junction between the upper surface of the cap and the face of its lateral wall; this part of the cut-out may be extended in the return by two descending limbs to form, in said return, the deformation panel. Preferably the cut-out is provided in such a manner that the height of the panel may be such that its upper edge is disposed slightly below the lower face of the upper wall of the cap for enabling the panel to move aside under this face and to permit gripping of the edge of the plate thereabove.

In this embodiment, said edge of the plate there above is preferably slightly displaced towards the axis of the cap in order to be able to mould the assembly without needing a movable slide.

The cut-out is advantageously provided with a portion of the plate equidistant from its two edges but equally, in a variant, the cut-out may be extended just up to one of said edges in such a way that said edge also serves as part of the cut-out permitting hinging of the panel.

The hinging movement of the panel is preferably inwardly, as mentioned above. However, one may also arrange the cut-out or deformising the panel the panel deforms outwardly and, by thus enlarging the panel, gripping the pilfer-proof plate.

Thanks to the invention, by arranging the return at the same level as the lateral wall of the cap, a maximum length in the diametral direction may be available inwardly of the cap to receive the pushbutton whose rear end, intended to be operated by the user, may be at a small distance from the lateral wall and of the return.

BRIEF DESCRIPTION OF THE DRAWINGS

Other advantages and characteristics of the inventions will appear, from a reading of the following description made by way of non-limiting example and with reference to the accompanying drawings. On these drawings.

DESCRIPTION OF THE PREFERRED EMBODIMENTS

Figure 1:
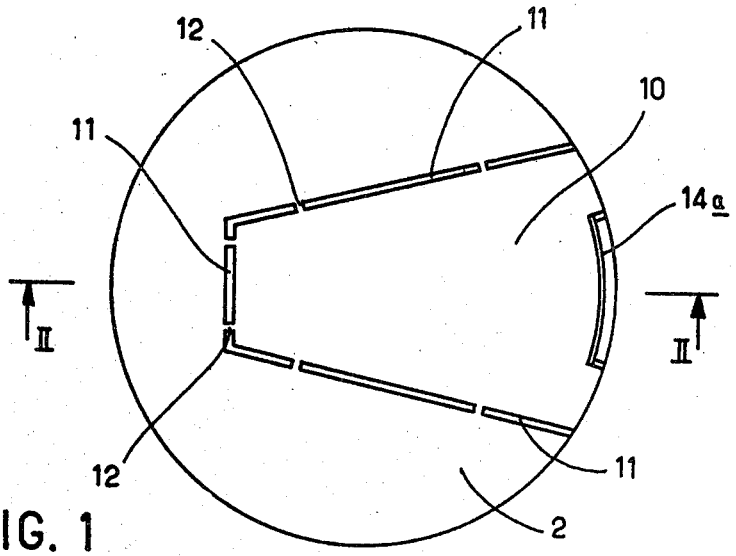
FIG. 1 shows an underneath view of a cap according to the invention.

The cap according to the invention, as illustrated, has a generally cylindrical form with a lateral wall 1 and an upper wall 2. The lateral wall 1 presents at its end a window situated opposite the discharge nozzle 4 of the push button 5 mounted pivotally in the cap 1.

Figure 2:
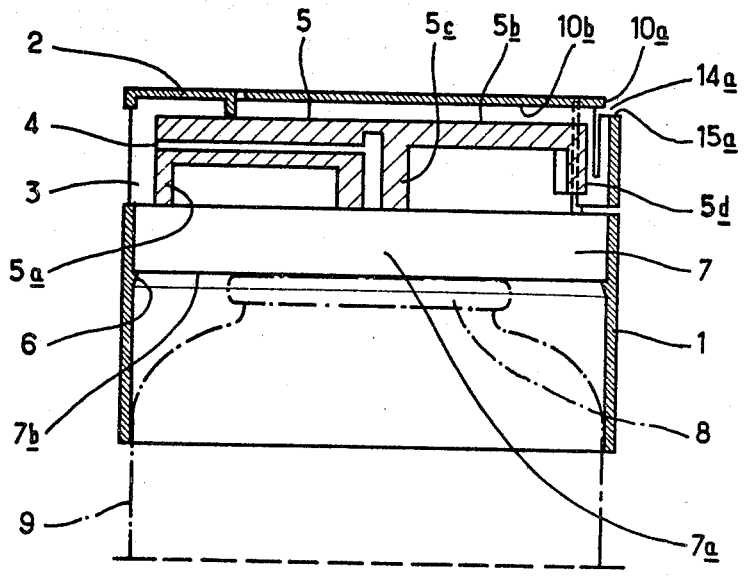
FIG. 2 shows a transverse sectional view on line II—II of FIG. 1.

In its interior, the lateral wall of the cap 1 presents an internal relief 6 permitting mounting on the interior of the cap of a sleeve 7 which is not shown in section in FIG. 2, said sleeve being able for example to have a diabolo shape for, on the one hand, contacting the internal face of the wall 1 at the level of the window 3 and the part of the cap diametrically opposed to the window 3, so that in the narrowest part of the diabolo the lower edge **7*b* of the sleeve may abut against the crimped edge of a valve-carrying cup of a container 9** shown in dotted lines.

Within the sleeve a push button 5 is articulated, preferably by a thin film hinge moulded integrally with the sleeve, at the level of its rear end **5*a***.

It will be understood that by bearing on the rear edge **5*b* of the push button it may be possible to rock the push button 5 and, by the descending movement of its central part 5*c*, to provoke opening of the valve (not shown) of the container and pulverization through the nozzle 4**.

Figure 3:
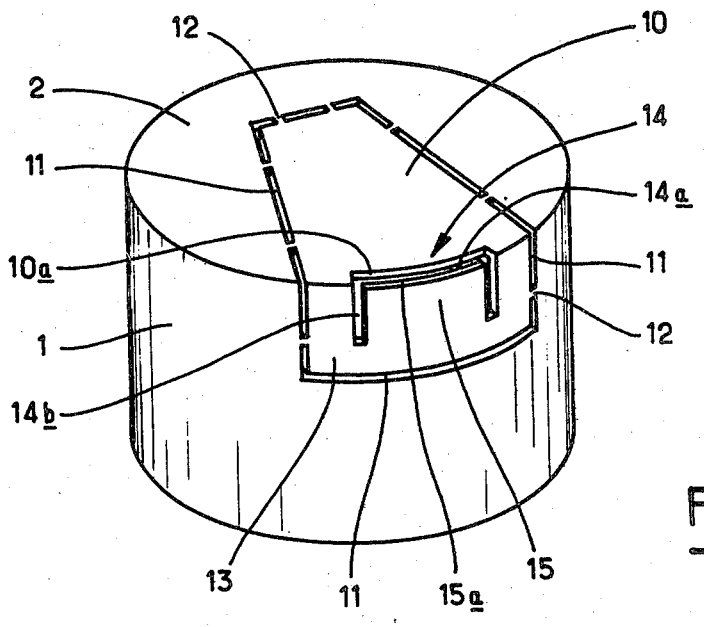
FIG. 3 shows a perspective view of this cap with the pilfer-proofing plate in place.
Figure 4:
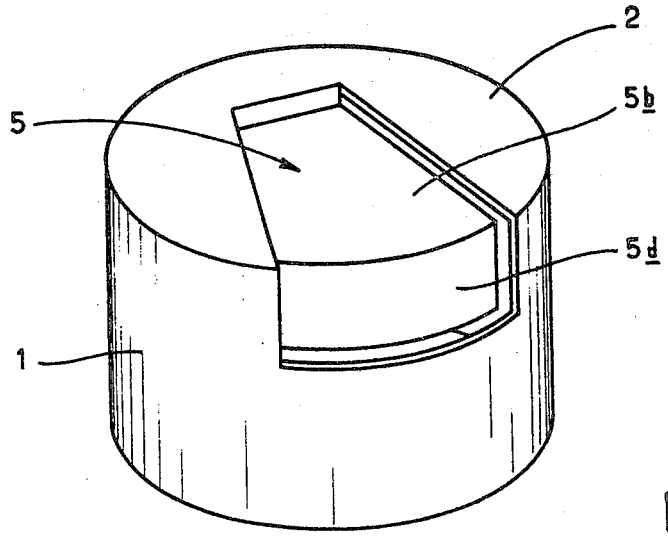
FIG. 4 shows a perspective view of cap with the plate removed, exposing a part of the push button.

The upper face 2 of the container presents a pilfer-proofing removable wall 10 having a substantially trapezoidal form and separated from the wall 2 proper by a continuous groove with, from time to time, tearable or frangible connections 12. As can be seen in particular in FIG. 3, the pilfer-proofing plate 10 is followed, flush with the lateral wall 1, by a right angle return 13 of cylindrical form. This return 13 which is intended to be torn away and to remove at the same time the planar part of the plate 10, closes a window formed in the lateral wall 1 and diametrically of the opposite to the window 3.

At the level of the line of separation between the planor part of the plate 10 and the return 13 is a cut-out 14 having substantially the form of a U with one horizontal curved limb **14*a* and two vertical rectilinear limbs 14*b*. This cut-out defines in the return 13 a panel 15 which it will be understood can be depressed elastically towards the interior of the cap by the user. In effect the upper edge 15*a* of the panel 15*b* which defines the part 14*a* of the cut-out is disposed at a level slightly lower than the interior face 10*b* of the plate 10. Futhermore the edge 10*a* of the cut-out at the level of the planar part of the plate 10** is slightly displaced towards the centre by a distance sufficient to permit simple removal of a mould permitting injection of the upper part of the cap in a vertically ascending direction.

With reference now to FIG. 2, it will be seen that the push button in its part **5*b* presents a return 5*d* situated at a small distance from the panel 15**. It is thus possible to give the push button a diametral length as great as possible taking into account the dimensions of the cap.

To remove the plate 10, the operator commences to press on the upper part of the panel 15 so as to hinge this panel slightly inwardly until the end of the operator's finger arrives at the edge **10*a* which thus enables him to raise and remove the plate 10 with its return 13**.

It will however be understood that as a variant it is possible to provide the panel 15 in such a way as to be on the contrary hingable outwardly and to increase the length of the cut-out permitting gripping of the edge **10*a* for removing the plate 10**.

In another variant, it will be understood that the cut-out may, instead of being disposed centrally, be disposed laterally so that one of its limb branches **14*b* may be constituted by the vertical part of the slot 11 between the plate 10** and the rest of the cap.

Although the invention has been described as regards one particular embodiment, it will of course be understood that it is in no way limited and that it is possible to incorporate various modifications without thereby departing from its scope or spirit.

I claim:

1. In a dispensing cap for a pressurized container, comprising:

(a) an upper wall (b) a lateral wall around said upper wall;

(c) a push button with said lateral wall and having an upper face below and close to said upper wall;

(d) a pilfer-proofing plate having an upper external face and a lower internal face and arranged above the push button frangible connections connecting said plate to the rest of the cap;

(e) a return to said pilfer-proofing plate at its extremity near the lateral wall of the cap; and (f) means for permitting easy gripping of said pilfer-proofing plate in order to tear it off, the improvement wherein:

(g) said return is flush with said lateral wall; and (h) said pilfer-proofing plate presenting, at this end, a cut-out defining, on said return, a panel capable of hinging by elastic deformation to move aside at least partially and to permit access to an edge of the cut-out which, once gripped, enables said plate to be torn away to gain access to the push button, said cut-out comprising a substantially horizontal part and two descending limbs.

2. A cap according to claim 1, wherein the push button has a rear end which is disposed in the vicinity of said return.

3. A cap according to claim 1 wherein said panel is deformable, under the pressure of a finger, towards the interior of the cap to permit gripping of the cut-out at the part of the pilfer-proofing plate facing the panel.

4. A cap according to claim 1 wherein said cut-out includes a horizontal limb and the horizontal limb of the cut-out is situated at the level of the zone of geometrical junction between the upper face of the cap and the return.

5. A cap according to claim 1, wherein the return has lateral edges and the descending limbs of the cut-out are both disposed inwardly of said lateral edges of the return.

6. A cap according to claim 1, wherein said pilfer-proofing plate has means defining a slot separating said return from the remainder of the plate, and one of the limbs of the cut-out is constituted by the corresponding portion of said slot.

7. A cap according to claim 1, wherein the upper edge of the panel formed by the cut-out is situated at a lever lower than said lower internal face of the plate.

8. A cap according to claim 1, wherein the cut-out has an edge presented by the plate and said edge is, relative to the lateral wall of the cap, displaced towards the axis of the cap.

9. A cap according to claim 1, and including a sleeve embedded therewithin to be applied against the pressurized container, said sleeve pivotally supporting said push button contained within the cap.

* * * * *